US011219341B2

(12) United States Patent
Mclean et al.

(10) Patent No.: US 11,219,341 B2
(45) Date of Patent: Jan. 11, 2022

(54) URINAL APPARATUS WITH CONSUMABLE CAP

(71) Applicant: WhiffAway Ltd., High Wycombe (GB)

(72) Inventors: James Edward Mclean, Beaconsfield (GB); Sebastian Nikolai Jonathan Marshall, Beaconsfield (GB)

(73) Assignee: WhiffAway Ltd., High Wycombe (GB)

( * ) Notice: Subject to any disclaimer, the term of this patent is extended or adjusted under 35 U.S.C. 154(b) by 0 days.

(21) Appl. No.: 17/144,996

(22) Filed: Jan. 8, 2021

(65) Prior Publication Data

US 2021/0219796 A1 Jul. 22, 2021

(30) Foreign Application Priority Data

Jan. 20, 2020 (GB) ..... 2000793

(51) Int. Cl.
*A47K 11/12* (2006.01)

(52) U.S. Cl.
CPC ..... *A47K 11/12* (2013.01)

(58) Field of Classification Search
CPC ..... A47K 11/12
USPC .... 4/462, 449, 463, 464, 222, 459; 210/632, 210/638, 660, 696, 702, 749, 198.1; 422/1, 243; 424/40, 76.1; 510/109, 382, 510/440, 447, 406, 439
See application file for complete search history.

(56) References Cited

U.S. PATENT DOCUMENTS

| | | | |
|---|---|---|---|
| 5,165,119 A | 11/1992 | Yamato | |
| 2011/0277229 A1 | 11/2011 | Connor | |

FOREIGN PATENT DOCUMENTS

| | | | | |
|---|---|---|---|---|
| EP | 1657370 A2 * | 5/2006 | ..... | E03C 1/281 |
| EP | 2487303 A2 * | 8/2012 | ..... | C11D 17/0056 |
| GB | 2449364 A | 11/2008 | | |
| GB | 2473055 A | 3/2011 | | |
| WO | WO-2009040524 A1 * | 4/2009 | ..... | E03C 1/298 |
| WO | WO-2011120179 A1 * | 10/2011 | ..... | E03D 13/005 |

OTHER PUBLICATIONS

United Kingdom Intellectual Property Office, Search Report, dated Jun. 17, 2020, 3 pages.

* cited by examiner

*Primary Examiner* — Lori L Baker
(74) *Attorney, Agent, or Firm* — Perkins IP Law Group LLC; Jefferson Perkins

(57) ABSTRACT

The improved urinal apparatus is configured for insertion in an outlet of a urinal. The urinal apparatus includes a hollow body defining an upper housing and a clamp ring/lower housing. The upper housing provides an open chamber configured to receive and retain a consumable detergent/malodour counteractant and the clamp ring/lower housing is configured to support and retain a resealing valve, which is operable to allow flow of fluid, such as urine, from above, but is operable to prevent backflow from below the resealing valve. The urinal apparatus also includes a consumable cap element, which includes an axial opening at least partway through, wherein the opening is configured to receive at least part of the upper housing. A body of the cap element comprises a plurality of radially extending fins. One of the upper housing or the consumable cap element comprise an upper member comprising an array of holes, which facilitate fluid flow and insertion and extraction of the urinal apparatus as a unit.

20 Claims, 3 Drawing Sheets

URINAL APPARATUS WITH CONSUMABLE CAP

FIELD OF THE INVENTION

The present invention relates to an apparatus for a urinal, particularly, but not exclusively to an outlet fitting for a waterless or a low water usage urinal.

BACKGROUND OF THE INVENTION

Waterless or low water usage urinals have become popular in recent years as the financial and environmental cost of supplying water becomes more important to water consumers. However, where there is no rinsing there is concern about smells and odours of urine and how to maintain such systems.

Using waterless/low water urinals is expected to reduce overall expenditure because spending on a waterless/low water urinal is considered to be less in comparison with fitting and maintaining flushed (water using) urinals. Waterless/low water urinals are intended to meet environmental goals because their use reduces water usage because water is only used periodically for washdown/to aid cleaning the system. In terms of current environmental goals, the waterless/low water urinal, by implication, reduces the implementation site's carbon footprint.

In the UK the water supply in many areas is "hard water". It will be appreciated that this has a negative implication of using water to flush urinals because the limescale content in the "hard water" can cause problems in urinals because supply pipes and cisterns can become 'furred up' over time. When this happens the pipes and cisterns require descaling to ensure efficient flushing of the urinal. In this regard, it will be appreciated "furring up" occurs due to the limescale combining with the uric acid salts in urine to form a hard scale, which gradually, through time, builds up and can, if not maintained, block the waste pipes. The scale build-up provides a foundation to which bacteria can adhere, and multiply. This is particularly problematic and undesirable when the scale/limescale deposits are on the surface of the urinal bowls.

In view of the above, it will be appreciated, a waterless or low water urinal saves water, reduces expenditure on water and related sewerage costs, improves hygiene because the urinal is easier to clean, lowers maintenance costs because there is no flush control system, cistern or water supply pipes to maintain, no flood risk and reduced incidence of waste pipe blockage; we say reduced because often foreign objects find their way into the waste pipe system.

From the above, it will be appreciated a waterless/low water urinal is a urinal which requires no flushing and may include a specially designed trap which utilises urine to form a liquid seal to prevent back odours from the soil stack being emitted through the urinal. Other waterless urinals may feature oil filled traps or non-return valves which do not rely on a liquid based seal. Conventional waterless urinals include a disposable cartridge which contains a consumable deodoriser. The deodoriser gives off a pleasant odour which masks the smell of the urine contained within the trap. The physical size of the deodoriser reduces through contact with air and urine, and the cartridges are replaced periodically as part of a maintenance schedule. There are problems associated with such a regime however; for example, where there is more than one urinal, the time period between cartridge changes is determined by the requirements of the urinal which is used most heavily as the consumable deodoriser in this urinal will be consumed most quickly. In such a situation, the cartridges of other urinals in the same toilet may be replaced unnecessarily if they are changed as part of the periodic maintenance. Furthermore, when the cartridge is changed there is a significant amount of material which has to be disposed of.

SUMMARY OF THE INVENTION

According to a first aspect of the present invention there is provided a urinal apparatus configured for insertion in an outlet of a urinal, the urinal apparatus comprising:

a hollow body defining an upper housing and a lower housing;

an internal consumable detergent/deodoriser;

a resealing valve; and an externally mounted consumable cap element, wherein the upper housing provides an open chamber configured to receive and retain the consumable detergent/deodoriser and wherein the lower housing is configured to support and retain the resealing valve, which is operable to allow flow of fluid, such as urine, from above, but is operable to prevent back flow from below the resealing valve; and wherein the consumable cap element, which includes an axial opening at least partway through, wherein the axial opening is configured to receive at least part of the upper housing, wherein a body of the cap element comprises a plurality of radially extending fins, wherein one of the upper housing or the consumable cap element comprise an upper member comprising an array of holes, which facilitate fluid flow through the apparatus and facilitate, by interaction with an extraction tool, insertion and extraction of the urinal apparatus into and from a urinal as a unit.

The cap element may be manufactured from fragranced material, from which fragrance depletes and the cap element shrinks when fluid, in particular urine, makes contact with the cap element. The consumable cap element may be manufactured from fragranced Ethylene-vinyl acetate (EVA).

Providing a consumable cap and a consumable detergent/deodoriser unit in the urinal apparatus enhances the aroma in the vicinity of the urinal and masks the smell of urine, which is particularly important in waterless/low water urinals.

Each fin of the consumable cap may extend from a cylindrical centre section.

The radially extending fins may uniformly extend and may be uniformly distributed around a cylindrical centre section of the consumable cap element.

Each fin may be substantially triangular in shape comprising two curved edges and a straight edge, wherein the straight edge is defined by the junction of each fin and the cylindrical centre section.

The consumable cap may include at least two different sized fins arranged alternately about the cylindrical centre section in the order large, small, large, small etc, wherein the fins each include a straight edge defined by the junction of each fin and the cylindrical centre section and wherein large fins include a straight edge longer than the straight edge of the small fins and wherein upper surfaces of the large and small fins are substantially level. The large fins may each include a straight edge the length of the cylindrical centre section and the small fins each include a straight edge shorter than the corresponding edge of the large fin, wherein upper surfaces/vertices of the large and small fins are aligned, but lower surfaces/vertices of the large fins and short fins are not aligned. The lower surfaces/vertices of the short fins are offset from a lower edge of the cylindrical centre section and from the lower vertices of the large fins.

The consumable cap may be configured to dissolve in use and/or change colour in use as a replacement indicator.

The consumable detergent/deodoriser may be configured to dissolve in use.

Depletion of the consumable cap and/or the consumable detergent/deodoriser may indicate maintenance and/or replacement of the deodorising components.

The upper housing and lower housing may comprise separate elements, which fasten together to provide the hollow body. Fastening together the upper housing and lower housing may be by a snap-fit or push fit connection.

The hollow body may further comprise an adaptor insertable into the upper housing, wherein the adaptor is configured to support the consumable detergent/deodoriser and facilitate flow of fluid, in particular urine into the lower housing.

The upper housing may include the upper member comprising an array of holes configured and arranged to allow fluid flow into the hollow body. The array of holes may be shaped and distributed to also facilitate connection of an extraction tool, which is operable to engage with one or more of the array of holes and the upper member to facilitate insertion and removal of the urinal apparatus as a unit to/from the urinal outlet in which the urinal apparatus is located, in use.

The upper housing may be in the form of a tapered cylinder, wherein the cylinder wall tapers from a smaller circumference upper end to a larger circumference base, wherein the wall is divided into wall sections by longitudinal openings/windows defined through the wall.

Assembly of the consumable cap and the upper section may define an exposed grid portion, which is operable to prevent debris entering the urinal apparatus and the waste system to which the urinal apparatus is attached.

The windows represent an air-break, which ensures straight flow through the upper housing, reduced splashing and prevention of backflow of fluid from below.

The urinal apparatus may further comprise an adaptor insertable into the upper housing and operable to support the consumable deodoriser/detergent.

The windows through the upper housing facilitate visual inspection of the consumable deodoriser/detergent and a visual indication of depletion of the consumable deodoriser/detergent.

The upper housing may be connected to the lower housing by means of a snap-fit/push fit connection.

The lower housing may be configured as a clamp ring operable to clamp the resealable valve relative to the upper housing.

A further aspect of the invention provides a method of installing in and removing from a urinal outlet, the urinal apparatus of the first aspect, wherein the method includes engaging a key element to the upper member, locking the key element relative to the upper member and inserting or withdrawing the urinal apparatus.

A further aspect of the invention provides a method of disassembling the urinal apparatus of the first aspect when removed from a urinal outlet, wherein the method comprises utilising a blade key, inserting a bladed end of the blade key into a junction defined by the upper and lower housing, pivoting a free end of the blade key in the direction of one or both of the upper and lower housing thereby widening a gap at the junction and separating the upper and lower housing from each other.

BRIEF DESCRIPTION OF THE DRAWINGS

Embodiments of aspects of the invention will now be described with reference to the accompanying drawings in which.

DETAILED DESCRIPTION

Figure 1:
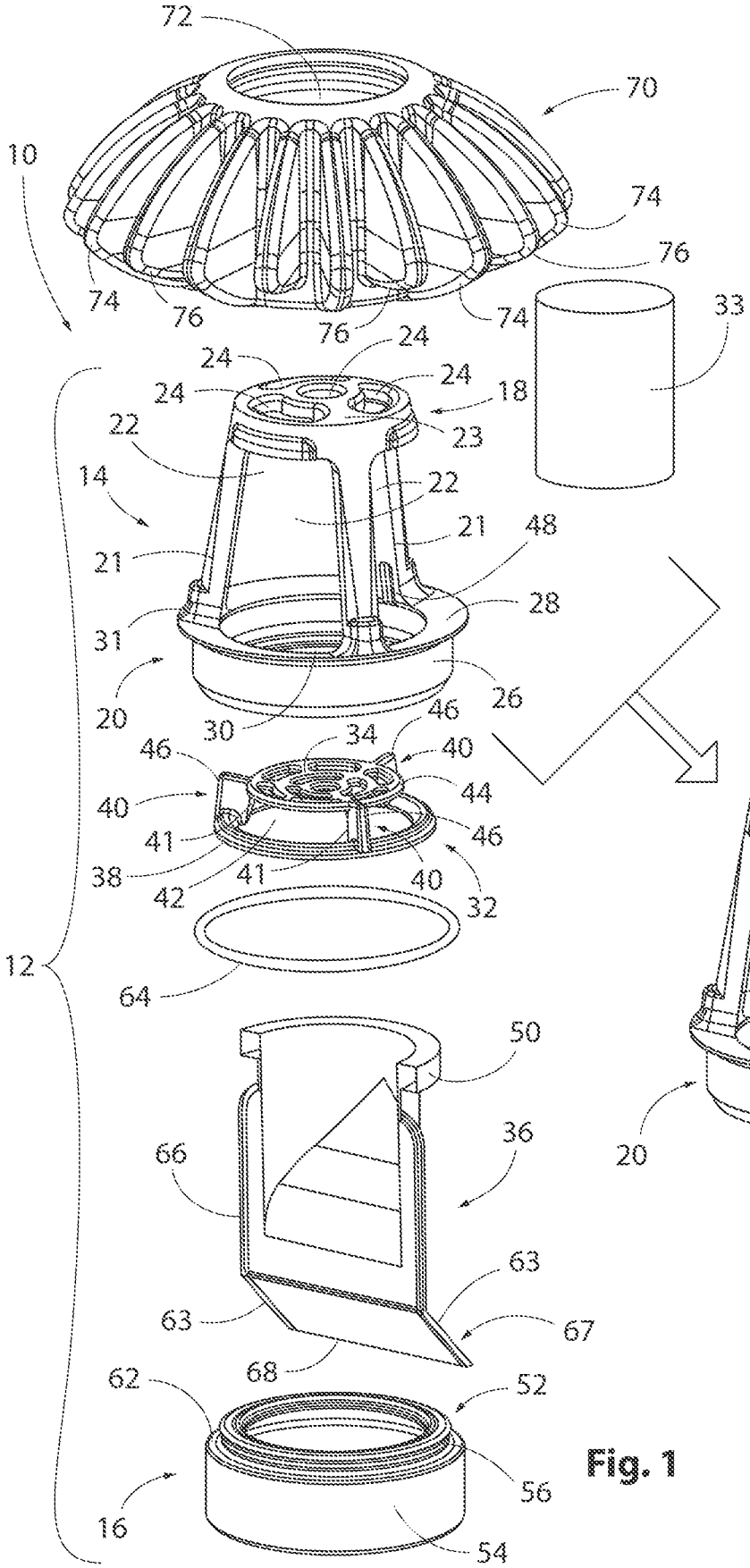
FIG. 1 is an exploded view of a urinal apparatus according to an example of the present invention.
Figure 2:
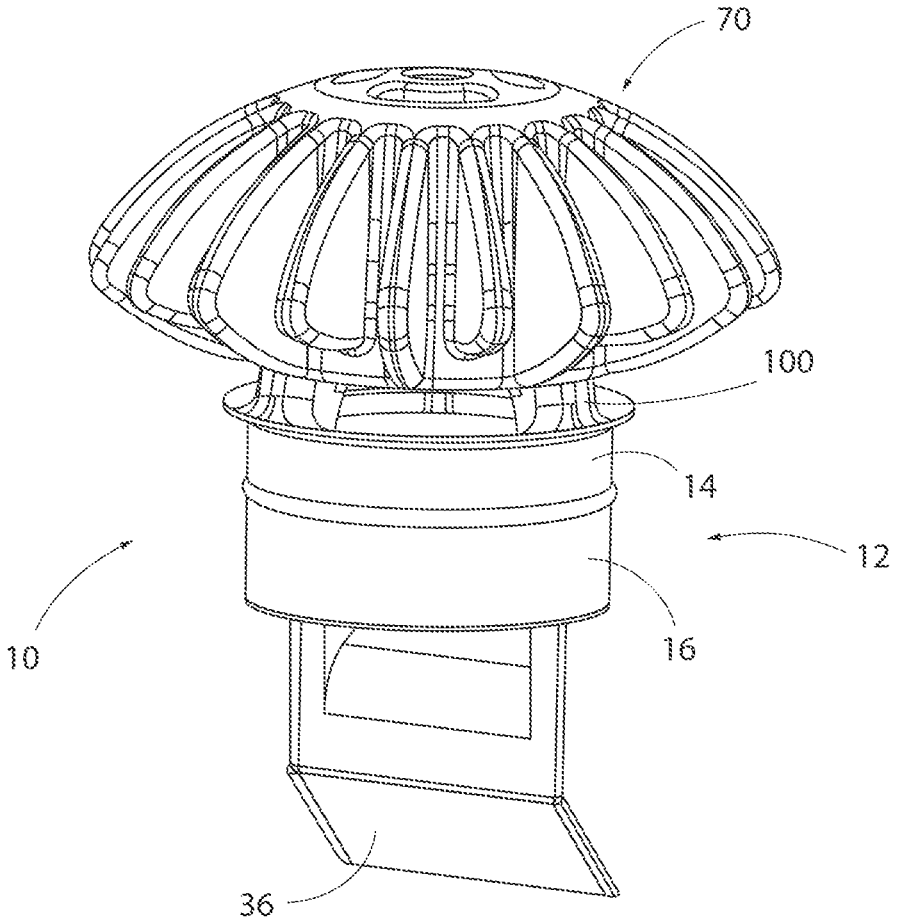
FIG. 2 is an assembled view of the urinal apparatus of FIG. 1.

A urinal apparatus 10 is illustrated in FIGS. 1 and 2. The urinal apparatus 10 is configured to be received in an outlet of a urinal (not illustrated). FIG. 1 shows an exploded view of the urinal apparatus 10, such that all components are visible i.e. all components includes those, that when assembled, are externally visible and those that are concealed internally. FIG. 2 represents an assembly of the components illustrated in FIG. 1 i.e. the urinal apparatus 10 is ready for use/installation in an outlet of a urinal.

Referring to FIGS. 1 and 2, the body 12 of the urinal apparatus 10 includes an upper housing 14 and a lower housing 16, which, in the illustrated example, are engageable to provide a unit for insertion into an outlet of a urinal (not illustrated).

The upper housing 14 is in the form of a tapered cylinder. In the illustrated example, the cylinder wall tapers from a smaller circumference upper end 18 to a larger circumference base 20. The wall is divided into wall sections 21 by longitudinal openings/windows 22 defined through the wall and between the wall sections 21; in the illustrated example three windows 22 are shown.

The windows 22 ensure straight flow through the upper housing 14 because the windows 22 represent an air-break, which is operable to reduce splashing and acts to prevent backflow of fluid from below.

The upper end 18 is partially closed by a disc 23 which includes an array of openings 24, which permit flow into the hollow void defined by the body of the upper housing 14 and also facilitates removal of the urinal apparatus 10 from the urinal outlet (not shown). The removal aspect of apparatus 10 using the disc 23 is described further below with regard to assembly, insertion and removal of the urinal apparatus 10 relative to a urinal outlet.

In the illustrated example the disc 23 is formed as an integral element of the upper housing 14.

Figure 1A:
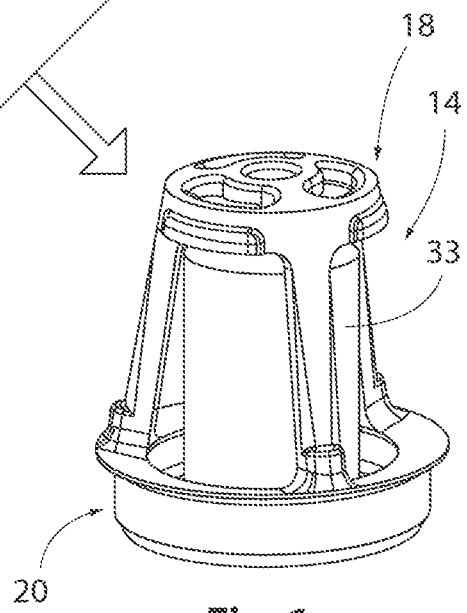
FIG. 1*a* is an assembled view of an upper housing and a dispersible deodorising/detergent block of FIG. 1.

The base 20 of the upper housing 14 is defined by a solid wall 26, an upper flange 28, a through bore 30 and a seal groove 31. The through bore 30 is sized and configured to receive an adaptor 32, which provides a platform 34 to support a consumable deodorising/detergent block 33 (see FIG. 1 and FIG. 1*a*) and facilitates securing a one-way/resealable valve, for example a duck-bill valve 36 and the lower housing 16 to the lower end of the base 20 of the upper housing 14.

In use, the deodorising/detergent block 33 erodes gradually with contact with urine and also counteracts malodours.

In the illustrated example, the adaptor 32 includes a base ring 38, and three support members 40, which define window sections 42 between them. When assembled, the arrangement of the support members 40 and window sections 42 correspond with the wall sections 21 and windows 22 in the upper housing 14.

An inside edge 41 of the upper end of the support members 40 engage with a perimeter edge 44 of the platform 34.

An outer edge 46 of the upper end of each support member 40 is configured to engage with a locating groove 48 provided on each internal face of the wall sections 21 of the upper housing 14.

When assembled, the outer edge 46 of each support member 40 engages with a corresponding locating groove 48 ensuring alignment of the windows and window sections i.e. alignment of the windows 22 in the upper section 14 with the window sections 42 defined in the adaptor 32. Engaging the outer edges 46 and the locating grooves 48 ensures alignment of the windows 22 and window sections 42 and ensures maximum flow rate vertical flow of fluid through the urinal apparatus 10.

When assembled, in the illustrated example, the underside of the base ring 38 provides an engaging surface against which a flange 50 at the open upper end of the resealing valve i.e. the duckbill valve 36 is retained; this is described further below.

The lower housing 16 comprises a hollow clamp ring, which includes a profiled upper section 52, which corresponds in diameter to the flange 50 of the duckbill valve 36 and a lower cylindrical section 54.

Figure 4:
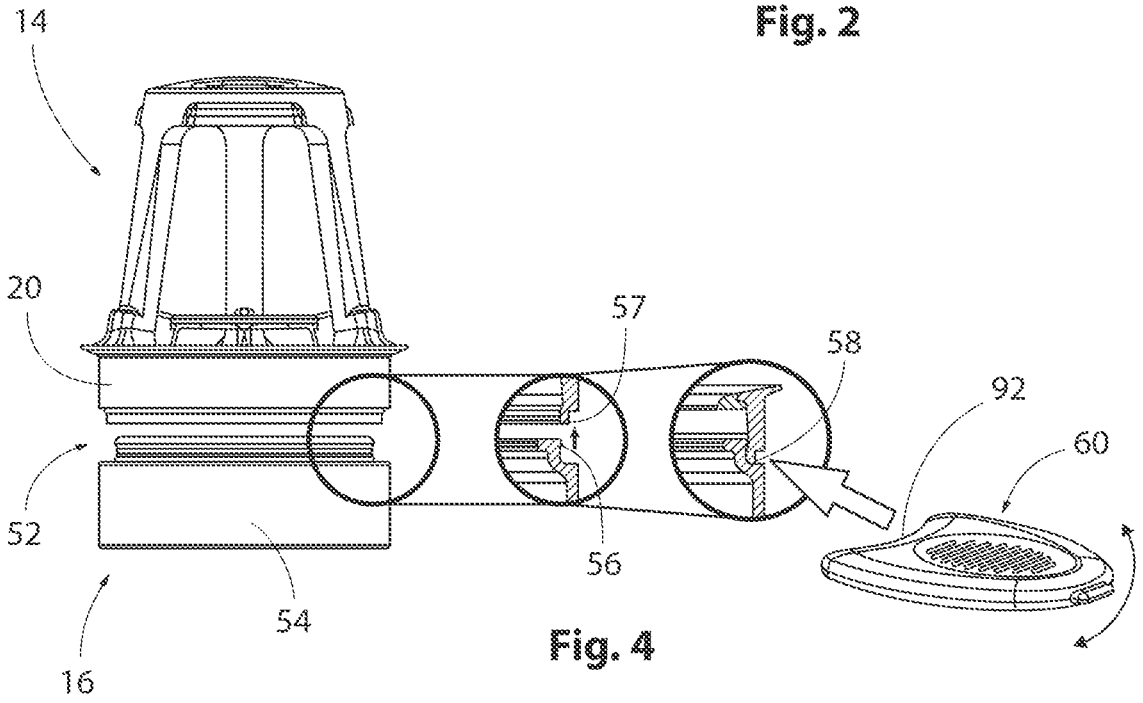
FIG. 4 illustrates assembly of the upper housing and the lower housing and how the upper housing and the lower housing from FIG. 2 can be separated using a blade key.

Referring to FIG. 4, the upper section 52 of the clamp ring/lower housing 16 is profiled and includes a lip 56, which engages with a lip 57 provided at the lower edge of the base 20 of the upper housing 14. Externally, interaction between the profiled section 52 and lip 57 defines a circumferential groove 58 at the interface of the upper housing 14 and the clamp ring/lower housing 16. The circumferential groove 58 facilitates separation of the upper housing 14 and lower housing 16 when the urinal apparatus 10 is removed from the urinal outlet. Separation of the upper housing 14 from the lower housing 16 is facilitated by insertion of a bladed end of a blade key 60 (see FIGS. 3 and 4) and slight rotation of the blade key 60 to expand the groove 58 and prise apart the upper housing 14 and lower housing 16.

A ledge 62 is defined between the profiled section 52 and the body of the clamp ring/lower housing 16. The ledge 62 facilitates retaining a seal i.e. an O-ring seal 64 when the upper housing 14 and the lower housing 16 are assembled.

In the illustrated example, assembly of the upper housing 14 to the lower housing 16 is by snap-fit of the lip 56 of the profiled section 52 and the lip 57 thereby retaining the flange 50 of the resealable, duckbill valve 36 between the engaging surface and the top face of the profiled section 52.

The resealable valve, for example a duckbill valve 36 is useful for preventing backflow of fluid/urine, unpleasant odours migrating towards the interior of room containing the urinal and for preventing animals, for example, rats crawling up from the sewer system into room/building via the outlet of the urinal.

In the illustrated example the resealable valve i.e. the duckbill valve 36 is made of thin flexible material (for example liquid silicone rubber (LSR) etc.). The material forming the main body 66 of the duckbill valve 36 is thin and pliable and is open at one end and closed at the other end. The closed end 67 resembles a duck's beak/bill, which is how the name of the valve 36 was derived. The open end includes a flange 50, whiCh is thicker, but of the same material as the body 66. The open end is upstream and is retained by the assembly of upper housing 14, the lower housing 16 and the adaptor 32. The closed end 67 is positioned downstream and remains loose or free to respond to flow flowing from the urinal outlet to the sewer.

The closed/free end 67 of the valve 36 is closed because two elements forming the duckbill-shaped free end 67 are arranged face-to face and include sealed longitudinal edges 63 with the bottom/end edge 68 being unsealed, but closed due to the face-to-face contact i.e. the free edges are in contact with each other. This arrangement of the closed end 67 prevents fluid flow and air flow from the upstream side of the duckbill valve 36 to the downstream side.

The duckbill valve 36 is configured such that the weight of fluid/urine permits flow from the downstream side to the upstreamside i.e. flow prompts the edges of the free end 67 of the valve 36 to open and let the urine/liquid pass downstream. When the pressure downstream of the valve is higher than upstream, the fluid tends to flow backwards. When this happens, the duckbill valve 36 due to its special shape, resists opening the free end 67 when the flow is reversed and in this ways, the duckbill valve 36 works as a one-way valve. The close proximity of the faces of the valve 36 at the free end 67 ensures that the valve 36 is resealable.

Figure 3:
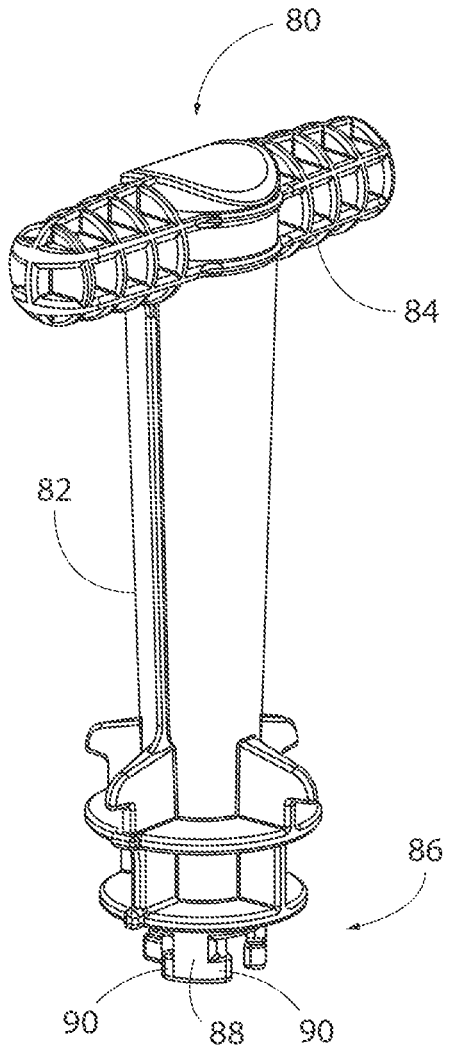
FIG. 3 illustrates an extraction tool engageable with an upper member of the urinal apparatus as illustrated in FIGS. 1 and 2.

The final component of the urinal apparatus 10, as illustrated in FIGS. 1, 2 and 3 is a consumable cap element 70. The cap 70 is consumable because it is made with fragranced Ethylene-vinyl acetate (EVA) which over time, the fragrance will deplete and the body of the cap 70 will shrink. After a certain period, for example thirty days, it is recommended to replace the cap 70.

In the illustrated example, the cap 70 includes a cylindrical centre section 72, which provides an axial bore through its centre. The axial bore facilitates assembly of the cap 70 with the upper housing 14 such that, in use the cap 70 is situated above the urinal outlet (not illustrated).

The overall shape of the cap 70 is similar to the head/cap of a mushroom. However, the body of the cap 70 is made of a plurality of radially extending fins 74, 76, which uniformly extend and are uniformly distributed around the cylindrical centre section 72.

In the illustrated example, two different sized fins 74, 76 form the body of the cap 70. The different sized fins 74, 76 are arranged alternately about the cylindrical centre section 72, In common, each fin 74, 76 is substantially triangular shaped (with two curved edges and a straight edge). Each straight edge is defined by the junction of each fin 74, 76 and the cylindrical section 72. One set of fins 74 are sized such that the straight edge extends from top to bottom of the cylindrical section 72. The fins 76 of the other set are shorter than the fins 74 and as such are sized such that each straight edge extends from the top of the cylindrical section, but the end of each straight edge and therefore the lower vertex is positioned above/short of the bottom edge of the cylindrical section 72.

The arrangement of the fins 74, 76 is such that adhesion of the urine/fluid passing over and between the fins 74, 76 is reduced i.e. the stepped arrangement that is defined by the base of the fins 74, 76 affects surface tension.

When assembled, the arrangement of the fins 74, 76 and the disc 23 directs fluid/urine through the centre of the urinal apparatus 10.

Assembly of the urinal apparatus 10, to provide a removable unit is as follows:

The resealable valve, for example a duckbill valve 36 is inserted into the stepped hollow clamp ring/lower housing 16 with the profiled section 52 arranged upwards and the duckbill end 67, 68 of the duckbill valve 36 arranged downwards;

The O-ring seal 64 is located on the ledge 62 defined on the lower housing 16;

The detergent/deodoriser/malodour counteractant block 33 and adaptor 32 are inserted into the upper housing 14 via the axial opening through the base 20 and are located appropriately by alignment of the outer edges 46 of the support members 40 and the grooves 48, such that the windows 22 and window sections 42 align;

Pushing together the partial assembly of the upper housing 14, adaptor 32 and deodorising/detergent block and the partial assembly of the lower housing 16, the duckbill valve 36 and the O-ring 64 such that the assembly becomes a unit that can be inserted and removed from the urinal outlet as a single unit.

The cap 70 can be applied as part of the assembled unit or can be attached to the unit after it is located in the urinal outlet.

FIG. 3 illustrates an example of an extraction tool 80 operable to install and remove the assembled urinal apparatus 10 to/from a urinal outlet.

In the illustrated example, the tool 80 is T-shaped, which includes a long shaft 82 with a head portion 84 at the upper end and a key portion 86 at the lower end. The key portion 86 is configured to engage with the openings 24 through the disc 23 to facilitate insertion/removal of the urinal apparatus 10 as a unit to/from the urinal outlet.

Figure 5:
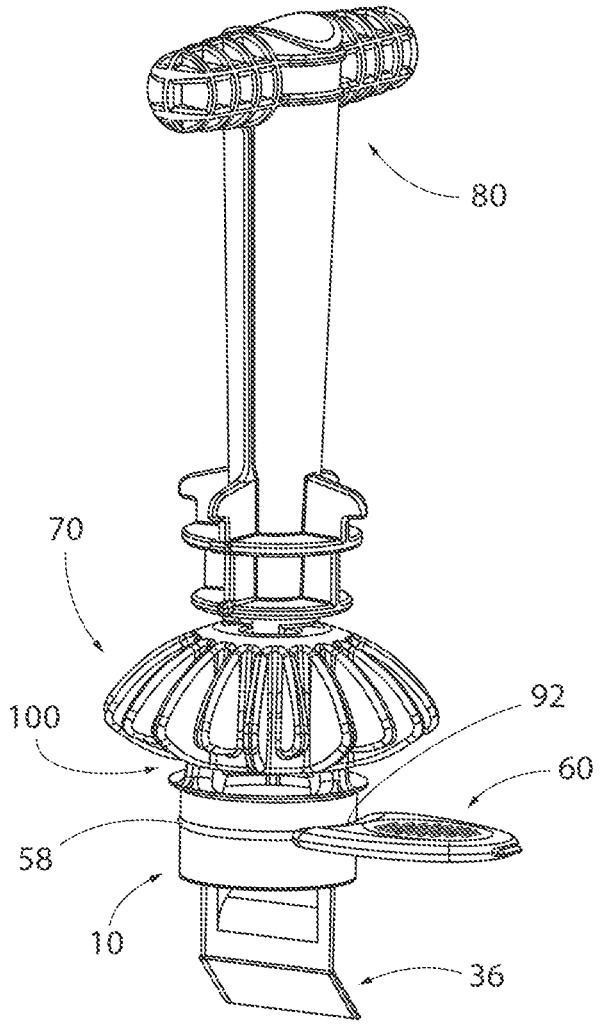
FIG. 5 illustrates interaction of the extraction tool, the blade key, and the fully assembled urinal apparatus 10.

FIG. 5 illustrates the extraction tool 80 engaged with the fully assembled urinal apparatus 10.

Regarding FIGS. 3 and 5, in the illustrated example the key portion 86 lockingly engages with the urinal apparatus 10 by virtue of a bayonet fitting i.e, the key portion 86 includes two or more protruding elements 88, each of which includes at least one lug 90, which is insertable into a window/opening 24 and is rotated such that the lugs 90 abut material of the disc 23 surrounding the opening 24 in which the protruding element 88 is inserted. Once engaged the extraction tool 80 can pull the urinal apparatus, as a unit, from the urinal outlet for replacement, maintenance etc.

In the illustrated example, the extraction tool 80 includes three protruding elements 88, each being T-shaped with two lugs 90 extending from each protruding element 88. This arrangement means that the key portion 86 can be inserted into the holes 24 and rotated clockwise or anti-clockwise to lock together the extraction tool 80 and the urinal apparatus 10.

To facilitate connection of the extraction tool 80, in the illustrated example the disc 23 includes three lozenge shaped holes 24 and a central hole 24' and the extraction tool 80 includes three similarly shaped protruding elements 88 with lugs 90.

It will be appreciated from the description above that the cap 70 can be removed from the urinal apparatus 10 without removing the urinal apparatus 10 from the urinal outlet. However, ideally, to prevent physical contact with any element of the urinal apparatus 10 the urinal apparatus 10 is removed as a single unit i.e. the assembled upper housing 14, lower housing 16, associated internal components and the cap 70 are removed by a single action using the extraction tool 80.

FIG. 4 illustrates a blade key 60 and how it is used. In the illustrated example, the blade key 60 is shaped like a plectrum/pick used with a stringed instrument. The blade key 60 is a small flat tool with an edge 92 configured for insertion into the groove 58 between the upper and lower housings 14, 16 (as described above with reference to FIG. 4) and operable to prise them apart to gain access to the adaptor 32 for removal or replacement of the deodorising/detergent block 33 (see FIGS. 1 and 1*a*) and to the duckbill valve 36 for removal/replacement.

FIG. 5 illustrates interaction of the extraction tool 80, the blade key 60, and the urinal apparatus 10.

In use, urine flows down the urinal walls and enters the urinal apparatus 10 over and between the fins 74, 76 of the consumable cap 70 and through the apertures/openings 24 defined in the disc 23 of the upper housing 14. Urine passes through the upper housing 14 in contact with the deodoriser/detergent block 33 and then through the duckbill valve 36 before exiting the apparatus 10 and through the urinal outlet.

Contact with urine increases the release of masking odours from the fragranced cap 70 and the deodoriser/detergent block 33 such that the urinal and the surrounding area smell pleasant and fresh.

Referring to FIGS. 2 and 5, the assembly of the cap 70 and upper section 14 ensures the inlet of the urinal apparatus 10 is raised relative to the drain/urinal outlet to which the urinal apparatus 10 is attached. A grid 100 is created by the assembly. The grid 100 is sized sufficiently to permit undisturbed flow of urine i.e. improved fluid dynamics and to prevent foreign debris from entering the waste system.

Above, the urinal apparatus 10 is described as being suitable for a waterless urinal. However, it should be appreciated that the urinal apparatus 10 is equally suitable for use with a urinal that incorporates a water seal (and water flushing facility) where the resealable valve 36 e.g. a duckbill valve can extend into a trap incorporating a water seal, for example a U-bend, a bottle trap etc.

Various modifications and improvements can be made to the above described embodiments without departing from the scope of the present invention.

We claim:

1. A urinal apparatus configured for insertion in an outlet of a urinal, the urinal apparatus comprising:

a hollow body defining an upper housing and a lower housing;

an internal consumable detergent/deodoriser;

a resealing valve and;

an externally mounted consumable cap element;

wherein the upper housing provides an open chamber configured to receive and retain the internal consumable detergent/deodoriser and Wherein the lower housing is configured to support and retain the resealing valve, which is operable to allow flow of fluid, such as urine, from above, but is operable to prevent back flow from below the resealing valve; and wherein the externally mounted consumable cap element includes an axial opening at least partway through, wherein the opening is configured to receive at least part of the upper housing, wherein a body of the cap element comprises a plurality of radially extending fins, wherein one of the upper housing or the consumable cap element includes an upper member comprising an array of holes, which facilitate, in use fluid flow through the apparatus and facilitate, by interaction with an extraction tool, insertion and extraction of the urinal apparatus into and from a urinal as a unit.

2. The urinal apparatus as claimed in claim 1, wherein the consumable cap element is manufactured from fragranced material, from which fragrance is emitted and depletes overtime in use when fluid, in particular urine, makes contact with the cap element.

3. The urinal apparatus as claimed in claim 1, wherein the cap element shrinks overtime in use when fluid, in particular urine, makes contact with the cap element.

4. The urinal apparatus as claimed in claim 1, wherein the consumable cap element is manufactured from fragranced Ethylene-vinyl acetate (EVA).

5. The urinal apparatus as claimed in claim 1, wherein each fin extends from a cylindrical centre section.

6. The urinal apparatus as claimed in claim 5, wherein the radially extending fins uniformly extend and are uniformly distributed around the cylindrical centre section of the consumable cap element.

7. The urinal apparatus as claimed in claim 5, wherein each fin is substantially triangular comprising at least one straight edge defined by the junction of each fin and the cylindrical centre section.

8. The urinal apparatus as claimed in claim 7, wherein each fin includes one Or more curved edges and a straight edge, wherein the straight edge is defined by the junction of each fin and the cylindrical centre section.

9. The urinal apparatus as claimed in claim 5, wherein the consumable cap includes at least two different sized fins arranged alternately about the cylindrical centre section in the order large, small, large, small etc, wherein We fins each include a straight edge defined by the junction of each fin and the cylindrical centre section and wherein large fins include a straight edge longer than the straight edge of the small fins and wherein upper surfaces of the large and small fins are substantially level.

10. The urinal apparatus as claimed in claim 9, wherein the length of the straight edge of large fins is the extent of the length of the cylindrical centre section.

11. The urinal apparatus as claimed in claim 1, wherein the consumable cap is configured to dissolve in use and/or change colour in use as a replacement indicator.

12. The urinal apparatus as claimed in claim 1, wherein the upper housing and lower housing comprise separate elements, which fasten together at a junction to provide the hollow body.

13. The urinal apparatus as claimed in claim 1, wherein fastening together the upper housing and lower housing is by a snap-fit connection.

14. The urinal apparatus as claimed in claim 1, wherein the hollow body includes an adaptor insertable into the upper housing, wherein We adaptor is configured to support the consumable detergent/deodoriser and facilitate vertical flow of fluid into the lower housing and through the resealing valve.

15. The urinal apparatus as claimed in claim 1, wherein the upper housing includes the upper member comprising the array of holes.

16. The urinal apparatus as claimed in claim 1, wherein the upper housing is in the form of a tapered cylinder, wherein the cylinder wall tapers from a smaller circumference upper end to a larger circumference base and wherein the wall is divided into wall sections by longitudinal openings/windows defined through the wall.

17. The urinal apparatus as claimed in claim 16, wherein assembly of the consumable cap and the upper section defines an exposed grid portion, which is operable to prevent debris entering the urinal apparatus and the waste system to which the urinal apparatus is attached.

18. The urinal apparatus as claimed in claim 1, wherein the lower housing is configured as a clamp ring operable to clamp the resealable valve relative to the upper housing.

19. A method of installing in and removing from a urinal outlet, the urinal apparatus of claim 1, wherein the method includes engaging an extraction tool to the upper member, locking the extraction tool relative to the upper member and installing or removing the urinal apparatus as a single unit.

20. A method of disassembling the urinal apparatus of claim 12, comprising utilising a blade key, inserting a bladed end of the blade key into the junction between the upper and lower housing, pivoting a free end of the blade key in the direction of one or both of the rapper and lower housing thereby creating a gap at the junction and separating the upper and lower housing from each other.

* * * * *